US005520247A

United States Patent [19]

Gmelig Meyling et al.

[11] Patent Number: 5,520,247

[45] Date of Patent: May 28, 1996

[54] METHOD OF PRODUCING A FLUID FROM AN EARTH FORMATION

[75] Inventors: Robert H. J. Gmelig Meyling; Robert B. Stewart; Ivo P. J. M. Stulemeijer, all of Rijswijk, Netherlands

[73] Assignee: Shell Oil Company, Houston, Tex.

[21] Appl. No.: 401,826

[22] Filed: Mar. 10, 1995

[30] Foreign Application Priority Data

Mar. 10, 1994 [EP] European Pat. Off. ..... 94200629

[51] Int. Cl.[6] ..... E21B 43/00

[52] U.S. Cl. ..... 166/245; 166/369; 166/50

[58] Field of Search ..... 166/50, 243, 244.1, 166/245, 268, 369

[56] References Cited

U.S. PATENT DOCUMENTS

| | | | |
|---|---|---|---|
| 459,826 | 9/1891 | Cook | 166/50 X |
| 702,006 | 6/1902 | Huffman | 166/50 |
| 2,365,428 | 12/1944 | Muskat | 166/268 |
| 2,548,059 | 4/1951 | Ramsey | 166/268 X |
| 2,736,381 | 2/1956 | Allen | 166/9 |
| 2,856,000 | 10/1958 | Barron | 166/9 |
| 3,258,069 | 6/1966 | Hottman | 166/265 X |
| 3,354,952 | 11/1967 | Engle | 166/306 X |
| 3,361,202 | 1/1968 | Whipple | 166/306 X |
| 3,442,333 | 5/1969 | Meldau | 166/369 X |
| 4,194,580 | 3/1980 | Messenger | 175/61 |
| 4,519,463 | 5/1985 | Schuh | 175/61 |
| 5,133,410 | 7/1992 | Gadelle et al. | 166/308 |
| 5,133,411 | 7/1992 | Gadelle et al. | 166/370 |

FOREIGN PATENT DOCUMENTS 435727 3/1991 European Pat. Off. .

OTHER PUBLICATIONS

"Drainage Tool Finding Uses for Many Reservoir Conditions," *Offshore/Oilman,* pp. 30–33, 39 (Feb. 1993).

Stephen P. Fischer, "Drilling and Completion of Horizontal Wells," Maersk Olie og Gas A/S, Copenhagen, Denmark (undated).

*Primary Examiner*—Roger J. Schoeppel

[57] ABSTRACT

A method of producing a fluid from an earth formation is disclosed having a first fluid zone, a second fluid zone extending at a horizontal distance from the first fluid zone and a barrier zone located between said fluid zones. The fluid is produced through a production wellbore having a fluid inlet located in the first fluid zone. The method includes creating an inclined wellbore section being part of an auxiliary wellbore formed in the earth formation, the inclined wellbore section extending through the first fluid zone, the barrier zone and the second fluid zone so as to provide fluid communication between the fluid zones, closing the auxiliary wellbore at a selected location so as to prevent flow of fluid from the fluid zones through the auxiliary wellbore to the earth surface, and producing fluid flowing from the second fluid zone via the inclined wellbore section into the first fluid zone and through the production wellbore.

36 Claims, 2 Drawing Sheets

FIG. 3
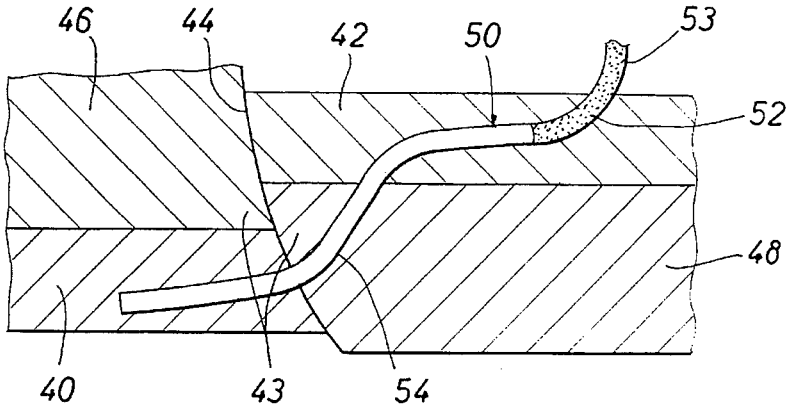
FIG. 4
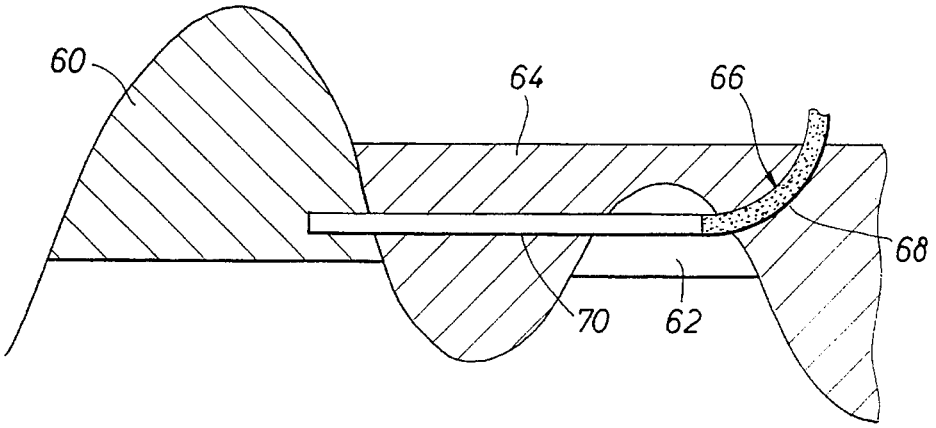
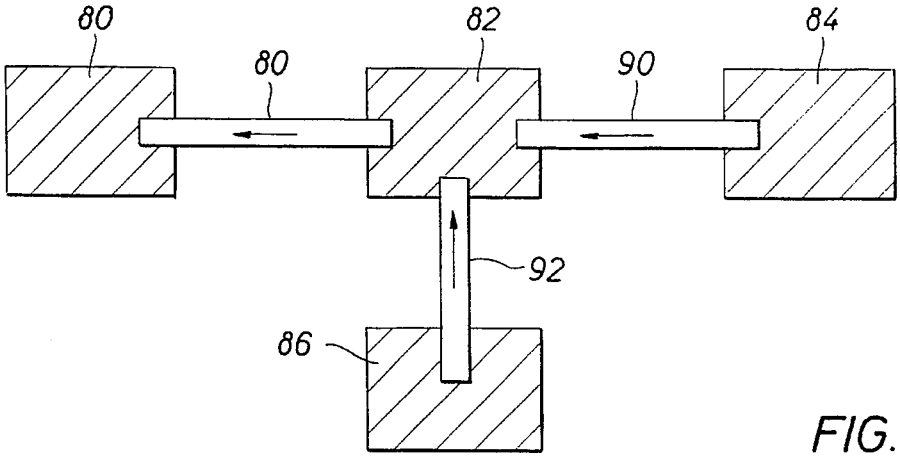
FIG. 5

METHOD OF PRODUCING A FLUID FROM AN EARTH FORMATION

BACKGROUND OF THE INVENTION

The present invention relates to a method of producing a fluid from an earth formation containing separate fluid zones extending at a distance from each other. Economic exploitation of fluid, for example oil or gas, from certain subsurface fluid zones can be economically prohibited due to unacceptably high development costs when conventional exploitation methods are applied. Such a situation can exist in the case of a relatively small offshore hydrocarbon reservoir, the development of which would require facilities such as subsea installations, an offshore platform, umbilicals and pipelines if conventional exploitation methods are applied. It is therefore desirable to provide a method of exploiting such fluid zones in an economically attractive manner.

U.S. Pat. No. 2,736,381 discloses a method of producing a fluid via a production wellbore formed in an earth formation, the earth formation comprising a first fluid zone and a second fluid zone extending at a distance from the first fluid zone, whereby a barrier zone vertically separates said fluid zones from each other. A vertical auxiliary wellbore passes through the barrier zone and extends into the two fluid zones so as to provide fluid communication between the fluid zones. The auxiliary wellbore is closed at its upper end, and fluid is produced which flows from the second fluid zone via the auxiliary wellbore into the first fluid zone and through the production wellbore. The second fluid zone is located below the first fluid zone, and the auxiliary wellbore extends vertically through both fluid zones so that the known method is not suitable to exploit separate fluid zones extending at a horizontal distance from each other.

It is an object of the invention to provide a method of economically producing a fluid from different fluid zones extending at a horizontal distance from each other.

SUMMARY OF THE INVENTION

An advantage of the invention is to provide a method of producing a fluid from an earth formation comprising a first fluid zone, a second fluid zone extending at a horizontal distance from the first fluid zone and a barrier zone located between said fluid zones. The fluid is produced through a production wellbore having a fluid inlet located in the first fluid zone. The method of the present invention comprises creating an inclined wellbore section as part of an auxiliary wellbore formed in said earth formation. The inclined wellbore section extends through the first fluid zone, the barrier zone and the second fluid zone so as to provide fluid communication between said fluid zones and the auxiliary wellbore is closed at a selected location so as to prevent flow of fluid from said fluid zones through the auxiliary wellbore to the earth surface. Fluids are produced flowing from the second fluid zone via the inclined wellbore section into the first fluid zone and through the production wellbore.

The inclined wellbore section provides a flow path for fluid flowing from the second zone to the first zone, thus bringing the two fluid zones into communication with each other. Such flow path cannot be provided by applying the vertical auxiliary wellbore of the prior art method because the fluid zones extend at a horizontal distance from each other. From a production point of view, the two fluid zones can be regarded as a single large fluid reservoir which can be produced from a single well or a single group of wells when the method according the invention is applied. The production wellbore can be an existing wellbore which has already been used to produce fluid from the first reservoir, or can be a new wellbore.

It is to be understood that the inclination of the inclined wellbore section is defined relative to vertical, so that the inclined wellbore section can for example extend in horizontal direction. It will be clear that the method according to the invention can advantageously be applied to exploit offshore fluid zones, such as offshore oil/gas fields, or fluid zones which underlay urban or environmentally sensitive areas.

The inclined wellbore section can be drilled from the first fluid zone into the barrier zone and the second fluid zone, or from the second fluid zone into the barrier zone and the first fluid zone. Alternatively the auxiliary wellbore can have an upper part extending into the barrier zone, for example a vertical upper part, from which upper part the inclined wellbore section is drilled substantially horizontally in the form of at least two wellbore branches, each branch extending into one of said fluid zones. Such system of a vertical wellbore part provided with multiple horizontal wellbore branches, also referred to as a multiple (root) well conduit system, can find application in compartmentalized rock formations.

The inclination angle of the inclined wellbore section is advantageously between 5–90 degrees from vertical, preferably between 45–90 degrees from vertical. The fluid zones and the barrier zone can be located in a common fluid reservoir, or the fluid zones can form separate fluid reservoirs separated from each other by the barrier zone.

The barrier zone can be, e.g., in the form of 1) an impermeable rock formation, 2) a rock formation of low permeability, for example a permeability between 1.5–2.5 mD, for example 2 mD, or 3) a rock formation at a geological fault formed in the earth formation. In any case the barrier zone substantially prevents direct flow of fluid from the second fluid zone to the first fluid zone, or vice versa. The barrier zone can also form a low permeable part of one of the fluid zones, in which case the inclined wellbore section can be brought in fluid communication fluid with the barrier zone in order to produce fluid contained in the barrier zone.

Suitably, the inclined wellbore section has an end part located in the first fluid zone and another end part located in the second fluid zone. Flow of fluid from the second fluid zone via the inclined wellbore section into the first fluid zone can be promoted by at least one of the steps of perforating the earth formation in at least one of the fluid zones around said inclined wellbore section and fracturing the earth formation in at least one of the fluid zones around said inclined wellbore section. The stability of the inclined wellbore section is enhanced when a liner is positioned in said inclined wellbore section, the liner being provided with a plurality of openings located in said first zone and said second zone, the liner being for example a slotted liner.

Closing of the secondary wellbore can be achieved in various manners, for example by creating a cement plug in an upper part of the auxiliary wellbore, or by installing a removable closure device at the upper part of the auxiliary wellbore.

A sensor for measuring the physical parameter can be installed in the inclined wellbore section before closing the auxiliary wellbore to obtain data on a physical parameter in the inclined wellbore section. The sensor communicates with surface equipment, transmitting signals representing said parameter from the sensor to the surface equipment. The physical parameter measured may, for example, be selected from the group of fluid pressure, fluid temperature, fluid density and fluid flow rate. The signals can be transmitted to the surface equipment via an electrically conductive wire extending through at least part of the auxiliary wellbore, which wire suitably extends from the sensor to a location at a selected distance below the upper end of the auxiliary wellbore, and which signals are transmitted from said location to the surface equipment by means of electromagnetic radiation.

In one embodiment of the method according to the invention, the fluid is water and the fluid zones are aquifers, whereby in an attractive application the second aquifer is located at an offshore location. Water from the offshore second aquifer can then be produced without requiring permanent offshore installations.

In another embodiment of the method according to the invention, the fluid is hydrocarbon and the fluid zones form hydrocarbon reservoirs. If the second hydrocarbon reservoir is located offshore, no permanent offshore production facilities are required to produce oil or gas from the second reservoir. In case both reservoirs are located offshore and the first reservoir has already been produced, existing production facilities of the first reservoir can be used to produce oil or gas from both reservoirs.

Furthermore the method according to the invention can be used to boost oil or gas production from an existing wellbore by directing the inclined wellbore section into a high pressure oil/gas zone so that thereby the pressure at the inlet of the production well is increased and the tendency of the well to produce water (water coning) is reduced.

BRIEF DESCRIPTION OF THE DRAWINGS

The brief description above, as well as further features and advantages of the present invention will be more fully appreciated by reference to the following detailed description which should be read in conjunction with the accompanying drawings in which:

FIG. 3 shows schematically a vertical cross-section through an earth formation in which a fault is present;

FIG. 4 shows schematically a vertical cross-section through another earth formation; and FIG. 5 shows schematically a system for use in the method according to the invention in which hydrocarbon is produced from several reservoirs.

DETAILED DESCRIPTION OF THE ILLUSTRATED EMBODIMENTS

Figure 1:
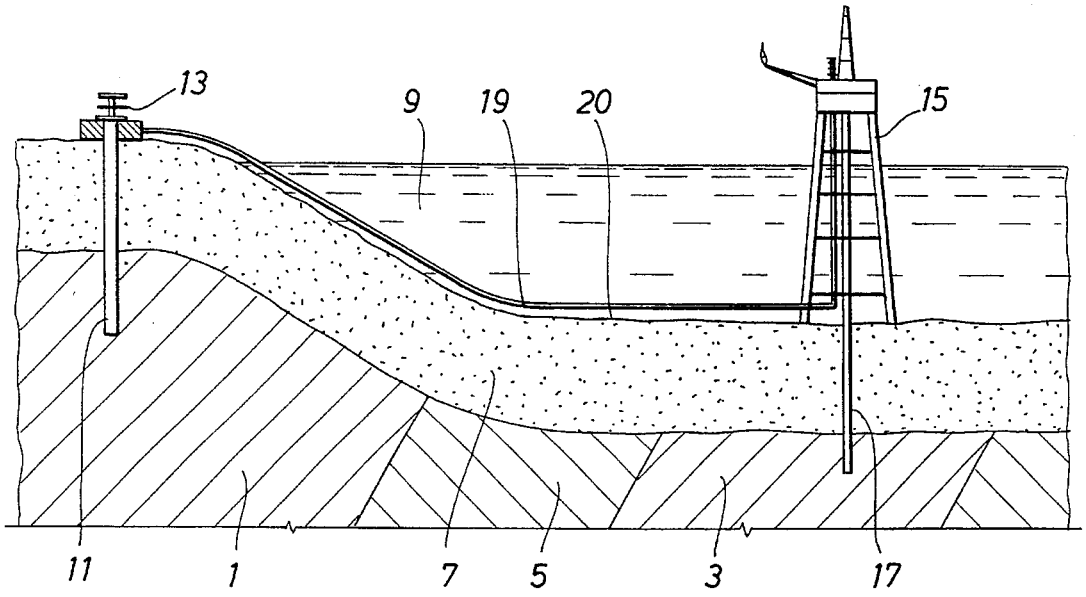
FIG. 1 (PRIOR ART)
FIG. 1 shows schematically a vertical cross-section through an earth formation with a prior art system for producing hydrocarbon fluid from a reservoir.

In FIG. 1 is shown a prior art system for the production of hydrocarbon from a first hydrocarbon reservoir 1 and a second hydrocarbon reservoir 3 are horizontally separated from each other by a barrier zone 5, here in the form of a rock formation impermeable to hydrocarbon fluid. An upper rock formation 7 overlies the reservoirs 1, 3 and the barrier zone 5. The second reservoir 3, the barrier zone 5 and part of the first reservoir 1 are located under a body of seawater 9, whereby the first reservoir 1 extends to below the onshore earth surface. An onshore hydrocarbon production wellbore 11 extends from the first reservoir 1 to a wellhead 13. Hydrocarbon fluid is produced from the first reservoir 1 via the wellbore 11 and is transported from the wellhead 13 to a processing facility (not shown). An offshore production platform 15 is located above the second reservoir 3, and hydrocarbon fluid is produced via a wellbore 17 extending from the platform 15 through the upper rock formation 7 and into the second reservoir 3. An export pipeline 19 extends from the platform 15 along the seabed 20 to the wellhead. Hydrocarbon fluid is produced from the second reservoir 3 via the wellbore 17 and is transported through the pipeline 19 to wellhead 13 and from there to the processing facility. It will be understood that considerable costs are involved with the prior art system because of the required production platform. These high costs may render certain hydrocarbon reservoirs, for example relatively small reservoirs, uneconomical to exploit.

Figure 2:
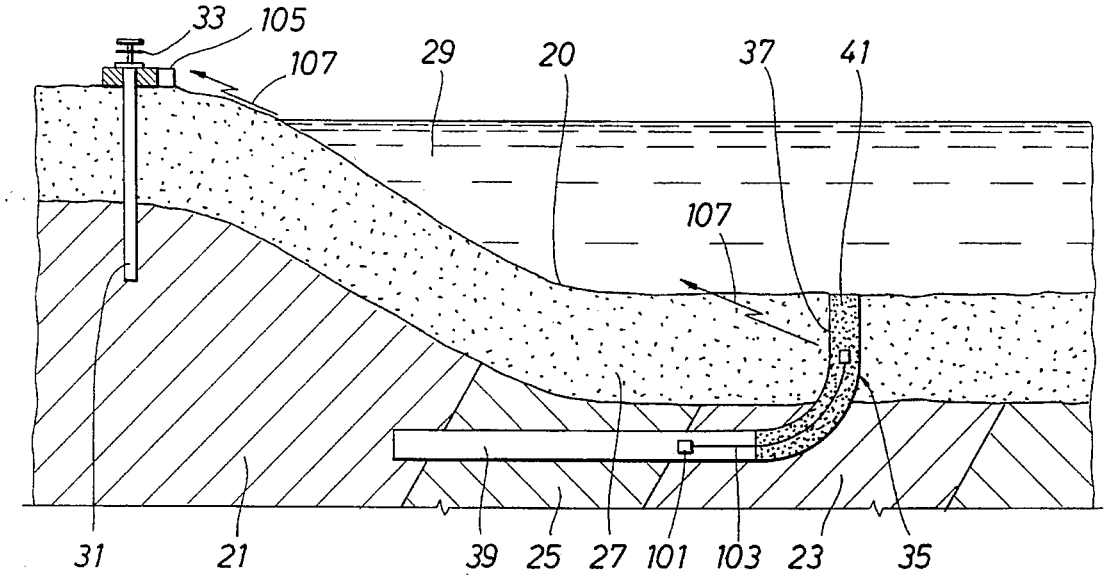
FIG. 2 shows schematically a vertical cross-section through an earth formation with a system used in the method according to the invention.

In FIG. 2 is shown an earth formation similar to the earth formation of FIG. 1 wherein a first hydrocarbon reservoir 21 and a second hydrocarbon reservoir 23 are horizontally separated from each other by a barrier zone 25 in the form of a rock formation impermeable to hydrocarbon fluid. An upper rock formation 27 overlies the reservoirs 21, 23 and the barrier zone 25. The second reservoir 23, the barrier zone 25 and part of the first reservoir 21 are located under a body of seawater 29, whereby the first reservoir 21 extends to below the onshore earth surface. An onshore hydrocarbon production wellbore 31 extends from surface to the first reservoir 21, and is provided with a wellhead 33. Hydrocarbon fluid is produced from the first reservoir 21 via the production wellbore 31 and the wellhead 33 to a processing facility (not shown). An auxiliary offshore wellbore has been drilled using a suitable drilling platform (not shown) which has been removed after drilling and completing the auxiliary wellbore 35. The wellbore 35 consists of an upper section 37 which is partially vertical and partially inclined relative to vertical, and a horizontal section 39. The upper section 37 extends from the seabed 20 through the upper rock formation 27 and the second hydrocarbon reservoir 23, and the horizontal section 39 extends from the lower end of the upper section 37 through the second reservoir 23, the barrier zone 25 and into the first reservoir 21. The horizontal section 39 is provided with a casing (not shown) which is perforated in both reservoirs 21, 23 to provide fluid communication between the reservoirs 21, 23. The casing has been magnetized to allow the position of the horizontal wellbore section 39 to be located at a later stage if required. Furthermore, flow of fluid from the second reservoir 23 via the wellbore section 39 into the first reservoir 21 is promoted by perforating the earth formation in said reservoirs 21, 23 around the wellbore section 39, and optionally further promoted by fracturing the earth formation in said reservoirs 21, 23 around the wellbore section 39. Thereafter the upper section 37 of wellbore is closed by filling said upper section 37 with a body of cement 41 and allowing the cement to harden.

During normal operation of the system shown in FIG. 2 hydrocarbon fluid is produced via wellbore 31 and wellhead 33. Depending on the presence of a fluid pressure difference between the reservoirs 21, 23, hydrocarbon fluid flows through the horizontal wellbore section 39. If the fluid pressure in the reservoir 23 is higher than the fluid pressure in the reservoir 21, for example due to partial depletion of reservoir 21, hydrocarbon fluid flows from reservoir 23 into reservoir 21. The fluid subsequently passes through the reservoir 21 to the wellbore 31 and from there to wellhead 33.

A pressure difference between reservoirs 21, 23 results from continued hydrocarbon production from wellbore 31 so that hydrocarbon fluid continuously flows from reservoir 23 through wellbore section 39 into reservoir 21. If the initial fluid pressure in reservoir 23 is equal to the initial fluid pressure in reservoir 21, hydrocarbon fluid will start to flow from reservoir 23 to reservoir 21 via wellbore section 39 only after a period of time when the pressure in reservoir 21 has become lower than the pressure in reservoir 23 due to continued fluid production via wellbore 31. In case the initial fluid pressure in reservoir 23 is lower than the initial fluid pressure in reservoir 21, hydrocarbon fluid initially flows from reservoir 21 to reservoir 23 via wellbore section 39 until the pressure difference vanishes. After continued production from reservoir 21 the pressure in reservoir 21 decreases so that hydrocarbon fluid flows from reservoir 23 via wellbore section 39 into reservoir 21 when the pressure in reservoir 21 becomes lower than the pressure in reservoir 23. Thus it is achieved that hydrocarbon fluid can be produced from the offshore reservoir 23 without the requirement of an additional offshore production platform.

Instead of producing hydrocarbon fluid from the onshore well location as shown in FIG. 2, such fluid can also be produced from an existing offshore well location. In that case use can be made of an existing offshore platform which is positioned above a first hydrocarbon reservoir and which produces hydrocarbon fluid therefrom. A remote second offshore hydrocarbon reservoir is then connected to the first reservoir in the same manner as reservoirs 21, 23 shown in FIG. 2 are connected. In this manner only one offshore platform is required in order to exploit the two hydrocarbon reservoirs.

A sensor 101 for measuring the physical parameter can be installed in the inclined wellbore section of before closing auxiliary wellbore 35 to obtain data on a physical parameter in the inclined wellbore section. Sensor 101 communicates with surface equipment, transmitting signals representing said parameter from the sensor to the surface equipment. The physical parameter measured may, for example, be selected from the group of fluid pressure, fluid temperature, fluid density and fluid flow rate. The signals can be transmitted to the surface equipment via an electrically conductive wire 103 extending through at least part of auxiliary wellbore 35, which wire 103 suitably extends from sensor 101 to a location at a selected distance below the upper end of the auxiliary wellbore, and which signals are transmitted from said location to the surface equipment 105 by means of electro-magnetic radiation indicated schematically by arrows 107.

In FIG. 3 is shown a first hydrocarbon reservoir 40 and a second hydrocarbon reservoir 42, the reservoirs 40, 42 being located at opposite sides of a geological fault 44. Impermeable rock masses 46, 48 surround the reservoirs 40, 42 and thereby form a fluid barrier between the reservoirs 40, 42. The reservoir 40 is partially depleted due to continued hydrocarbon production therefrom, and the reservoir 42 forms an undepleted relatively small reservoir of higher fluid pressure than the depleted reservoir 40. A auxiliary wellbore 50 has been drilled through the reservoirs 40, 42, the rock mass 48 and the geological fault 44. The auxiliary wellbore has an upper part 52 which is closed by a cement plug 53, and an inclined S-shaped lower part 54. The S-shaped part 54 provides fluid communication between the reservoirs 40, 42 so that hydrocarbon fluid flows from reservoir 42 through the S-shaped wellbore part 54 into the depleted reservoir 40 and is subsequently produced via a production wellbore (not shown).

In FIG. 4 is shown a dome-shaped first hydrocarbon reservoir 60, a dome-shaped second hydrocarbon reservoir 62, and an impermeable rock mass 64 which horizontally separates the reservoirs 60, 62. The reservoir 60 is partially depleted due to hydrocarbon production from a production wellbore (not shown), and the reservoir 62 forms an undepleted relatively small reservoir of higher fluid pressure than the partially depleted reservoir 60. An auxiliary wellbore 66 has been drilled through the reservoirs 60, 62 and the rock mass 64, which secondary wellbore 66 has an upper part 68 filled with cement so as to close the wellbore 66, and a horizontal lower part 70. The horizontal part 70 provides fluid communication between the reservoirs 60, 62 so that hydrocarbon fluid flows from reservoir 62 through the horizontal wellbore part 70 into the partially depleted reservoir 60 and is subsequently produced via the production wellbore.

In FIG. 5 is shown a scheme representing a first hydrocarbon reservoir 80, a second hydrocarbon reservoir 82, a third hydrocarbon reservoir 84 and a fourth hydrocarbon reservoir 86, the reservoirs 80, 82, 84, 86 being located at mutual horizontal distances. The reservoirs 80, 82 are interconnected by an inclined wellbore section 88, the reservoirs 82, 84 are interconnected by an inclined wellbore section 90 and the reservoirs 82, 86 are interconnected by an inclined wellbore section 92. The fluid pressures in reservoir 80 is lower than the fluid pressure in reservoir 82, and the fluid pressures in reservoir 82 is lower than the fluid pressure in reservoir 84 and also lower than the fluid pressure in reservoir 86. Thus hydrocarbon fluid flows from reservoirs 84, 86 through wellbore sections 90, 92 respectively into reservoir 82 and from there through wellbore section 88 into reservoir 80 from which the fluid is produced via a production wellbore (not shown).

A number of variations have been disclosed for producing fluid from an earth formation. However, other modifications, changes and substitutions are intended in the forgoing disclosure. Further, in some instances, some features of the present invention will be employed without a corresponding use of other features described in the illustrative embodiments. Accordingly, it is appropriate that the appended claims be construed broadly and in a manner consistent with the spirit and scope of the invention herein.

What is claimed is:

1. A method of producing a hydrocarbon fluid from an earth formation having a first hydrocarbon fluid zone, a second hydrocarbon fluid zone extending at a horizontal distance from the first hydrocarbon fluid zone and a barrier zone located between said hydrocarbon fluid zones, the method comprising:

creating an inclined wellbore section being part of an auxiliary wellbore formed in said earth formation, the inclined wellbore section extending through the first hydrocarbon fluid zone, the barrier zone and the second hydrocarbon fluid zone so as to provide fluid communication between said hydrocarbon fluid zones;

closing the auxiliary wellbore at a selected location so as to prevent flow of hydrocarbon fluid from said hydrocarbon fluid zones through the auxiliary wellbore to the earth surface;

producing hydrocarbon fluid through a production wellbore having a fluid inlet located in the first hydrocarbon fluid zone; and producing hydrocarbon fluid flowing from the second hydrocarbon fluid zone via the inclined wellbore section into the first hydrocarbon fluid zone and through the production wellbore.

2. A method for producing hydrocarbon fluid in accordance with claim 1, wherein said hydrocarbon fluid zones and the barrier zone are located in a common hydrocarbon fluid reservoir.

3. A method for producing hydrocarbon fluid in accordance with claim 1, wherein said hydrocarbon fluid zones form separate fluid reservoirs, which reservoirs are separated from each other by the barrier zone.

4. A method for producing hydrocarbon fluid in accordance with claim 3, wherein said barrier zone forms one of the group of a rock formation at a geological fault, a rock formation having a relatively low permeability for fluid contained in said hydrocarbon fluid zones, and an impermeable rock formation.

5. A method for producing hydrocarbon fluid in accordance with claim 1, wherein creating the inclined wellbore section further comprises extending the inclined wellbore section at least partially in horizontal direction.

6. A method for producing hydrocarbon fluid in accordance with claim 1, wherein creating the inclined wellbore section further comprises having an end part of the inclined wellbore section located in the first hydrocarbon fluid zone and another end part located in the second hydrocarbon fluid zone.

7. A method for producing hydrocarbon fluid in accordance with claim 1, further comprising promoting flow of hydrocarbon fluid from the second hydrocarbon fluid zone via the inclined wellbore section into the first hydrocarbon fluid zone by at least one of the steps of perforating the earth formation in at least one of the hydrocarbon fluid zones around said inclined wellbore section and fracturing the earth formation in at least one of the hydrocarbon fluid zones around said inclined wellbore section.

8. A method for producing hydrocarbon fluid in accordance with claim 7, further comprising positioning a liner in the inclined wellbore section, said liner being provided with a plurality of openings located in at least one of the hydrocarbon fluid zones.

9. A method for producing hydrocarbon fluid in accordance with claim 1, wherein closing the auxiliary wellbore comprises creating a cement plug in an upper part of the auxiliary wellbore.

10. A method for producing hydrocarbon fluid in accordance with claim 1, wherein closing the auxiliary wellbore comprises installing a removable closure device at an upper part of the auxiliary wellbore.

11. A method for producing hydrocarbon fluid in accordance with claim 1, further comprising:

installing a sensor in said inclined wellbore section before closing the auxiliary wellbore the sensor being in communication with surface equipment;

measuring physical parameters with the sensors; and transmitting signals representing said physical parameter from the sensor to the surface equipment.

12. A method for producing hydrocarbon fluid in accordance with claim 11, wherein said physical parameter to be measured is selected from the group of fluid pressure, fluid temperature, fluid density and fluid flow rate.

13. A method for producing hydrocarbon fluid in accordance with claim 12, wherein transmitting the signals comprises transmitting the signal to the surface equipment via an electrically conductive wire extending through at least part of the auxiliary wellbore.

14. A method for producing hydrocarbon fluid in accordance with claim 13, wherein:

installing a sensor further comprises installing a conductive wire extending from the sensor to a location at a selected distance below the upper end of the auxiliary wellbore; and transmitting signals further comprises using electro-magnetic radiation.

15. A method for producing hydrocarbon fluid in accordance with claim 1, wherein producing hydrocarbon fluid from the second hydrocarbon fluid zone further comprises lowering the fluid pressure in the first hydrocarbon fluid zone relative to the fluid pressure in the second hydrocarbon fluid zone by production of hydrocarbon fluid from the first hydrocarbon fluid zone.

16. A method for producing hydrocarbon fluid in accordance with claim 1, wherein at least said second hydrocarbon fluid zone is located offshore.

17. A method for producing hydrocarbon fluid in accordance with claim 1, wherein said hydrocarbon fluid substantially comprises natural gas.

18. A method of producing a hydrocarbon fluid from an earth formation having a first hydrocarbon fluid zone, a second hydrocarbon fluid zone extending at a horizontal distance from the first hydrocarbon fluid zone and a barrier zone located between said hydrocarbon fluid zones, the method comprising:

creating an inclined wellbore section being part of an auxiliary wellbore formed in said earth formation, the inclined wellbore section having a first end part located in the first hydrocarbon fluid zone, extending through the barrier zone and having a second end part in the second hydrocarbon fluid zone so as to provide fluid communication between said first and second hydrocarbon fluid zones;

installing a sensor in said inclined wellbore section in communication with surface equipment;

closing the auxiliary wellbore at a selected location so as to prevent flow of hydrocarbon fluid from said hydrocarbon fluid zones through the auxiliary wellbore to the earth surface;

producing hydrocarbon fluid through a production wellbore having a fluid inlet located in the first hydrocarbon fluid zone; and producing hydrocarbon fluid flowing from the second hydrocarbon fluid zone via the inclined wellbore section into the first hydrocarbon fluid zone and through the production wellbore, comprising:

promoting flow of hydrocarbon fluid from the second hydrocarbon fluid zone via the inclined wellbore section into the first hydrocarbon fluid zone, comprising:

positioning a liner in the inclined wellbore section, said liner being provided with a plurality of openings located each of the first and second end parts of the wellbore section;

perforating the earth formation in the first and second hydrocarbon fluid zones adjacent the first and second end parts of the inclined wellbore section, respectively;

fracturing the earth formation in at least one of the hydrocarbon fluid zones around said inclined wellbore section;

maintaining production from the first hydrocarbon fluid zone such that the pressure of the first hydrocarbon fluid zone is lower than the fluid pressure in the second hydrocarbon fluid zone;

measuring physical parameters with the sensors; and transmitting signals representing said physical parameter from the sensor to the surface and controlling the production accordingly.

19. A method of producing a hydrocarbon fluid from an earth formation having a first hydrocarbon fluid zone, a second hydrocarbon fluid zone extending at a horizontal distance from the first hydrocarbon fluid zone and a barrier zone located between said hydrocarbon fluid zones, the method comprising:

creating an inclined wellbore section being part of an auxiliary wellbore formed in said earth formation, the inclined wellbore section having a first end part located in the first hydrocarbon fluid zone, extending through the barrier zone and having a second end part in the second hydrocarbon fluid zone so as to provide fluid communication between said first and second hydrocarbon fluid zones;

installing a sensor in said inclined wellbore section in communication with surface equipment;

closing the auxiliary wellbore at a selected location so as to prevent flow of hydrocarbon fluid from said hydrocarbon fluid zones through the auxiliary wellbore to the earth surface;

producing hydrocarbon fluid through a production wellbore having a fluid inlet located in the first hydrocarbon fluid zone; and producing hydrocarbon fluid flowing from the second hydrocarbon fluid zone via the inclined wellbore section into the first hydrocarbon fluid zone and through the production wellbore, comprising:

promoting flow of hydrocarbon fluid from the second hydrocarbon fluid zone via the inclined wellbore section into the first hydrocarbon fluid zone, comprising:

positioning a liner in the inclined wellbore section, said liner being provided with a plurality of openings located each of the first and second end parts of the wellbore section;

perforating the earth formation in the first and second hydrocarbon fluid zones adjacent the first and second end parts of the inclined wellbore section, respectively;

fracturing the earth formation in at least one of the hydrocarbon fluid zones around said inclined wellbore section;

passing hydrocarbon fluid pressure from the second hydrocarbon fluid zone to the first hydrocarbon fluid zone through the auxiliary wellbore, increasing the fluid pressure at the fluid inlet of the production wellbore located in the first hydrocarbon fluid zone;

measuring physical parameters with the sensors; and transmitting signals representing said physical parameter from the sensor to the surface and controlling the production accordingly.

20. A method of producing a fluid from an earth formation having a first fluid zone, a second fluid zone extending at a horizontal distance from the first fluid zone and a barrier zone located between said fluid zones, the method comprising:

creating an inclined wellbore section being part of an auxiliary wellbore formed in said earth formation, the inclined wellbore section extending through the first fluid zone, the barrier zone and the second fluid zone so as to provide fluid communication between said fluid zones;

closing the auxiliary wellbore by creating a cement plug at a selected location in an upper part of the auxiliary wellbore so as to prevent flow of fluid from said fluid zones through the auxiliary wellbore to the earth surface;

producing fluid through a production wellbore having a fluid inlet located in the first fluid zone; and producing fluid flowing from the second fluid zone via the inclined wellbore section into the first fluid zone and through the production wellbore.

21. A method for producing fluid in accordance with claim 20, wherein said fluid zones and the barrier zone are located in a common fluid reservoir.

22. A method for producing fluid in accordance with claim 20, wherein said fluid zones form separate fluid reservoirs, which reservoirs are separated from each other by the barrier zone.

23. A method for producing fluid in accordance with claim 22, wherein said barrier zone forms one of the group of a rock formation at a geological fault, a rock formation having a relatively low permeability for fluid contained in said fluid zones, and an impermeable rock formation.

24. A method for producing fluid in accordance with claim 20, wherein creating the inclined wellbore section further comprises extending the inclined wellbore section at least partially in horizontal direction.

25. A method for producing fluid in accordance with claim 20, wherein creating the inclined wellbore section further comprises having an end part of the inclined wellbore section located in the first fluid zone and another end part located in the second fluid zone.

26. A method for producing fluid in accordance with claim claims 20, further comprising promoting flow of fluid from the second fluid zone via the inclined wellbore section into the first fluid zone by at least one of the steps of perforating the earth formation in at least one of the fluid zones around said inclined wellbore section and fracturing the earth formation in at least one of the fluid zones around said inclined wellbore section.

27. A method for producing fluid in accordance with claim 26, further comprising positioning a liner in the inclined wellbore section, said liner being provided with a plurality of openings located in at least one of the fluid zones.

28. A method for producing fluid in accordance with claim 20, wherein producing fluid from the second fluid zone further comprises lowering the fluid pressure in the first fluid zone relative to the fluid pressure in the second fluid zone by production of fluid from the first fluid zone.

29. A method for producing fluid in accordance with claim 20, wherein at least said second fluid zone is located offshore.

30. A method for producing fluid in accordance with claim 20, wherein said fluid forms a hydrocarbon fluid.

31. A method for producing fluid in accordance with claim 30, wherein said hydrocarbon fluid substantially comprises natural gas.

32. A method of producing a fluid from an earth formation having a first fluid zone, a second fluid zone extending at a horizontal distance from the first fluid zone and a barrier zone located between said fluid zones, the method comprising:

creating an inclined wellbore section being part of an auxiliary wellbore formed in said earth formation, the inclined wellbore section extending through the first fluid zone, the barrier zone and the second fluid zone so as to provide fluid communication between said fluid zones;

closing the auxiliary wellbore at a selected location so as to prevent flow of fluid from said fluid zones through the auxiliary wellbore to the earth surface;

producing fluid through a production wellbore having a fluid inlet located in the first fluid zone;

producing fluid flowing from the second fluid zone via the inclined wellbore section into the first fluid zone and through the production wellbore;

installing a sensor in communication with surface equipment into said inclined wellbore section before closing the auxiliary wellbore, said installing a sensor comprising:

installing a conductive wire extending from the sensor to a location at a selected distance below the upper end of the auxiliary wellbore; and transmitting signals further comprises using electromagnetic radiation;

measuring physical parameters with the sensors, said physical parameter to be measured being selected from the group of fluid pressure, fluid temperature, fluid density and fluid flow rate; and transmitting signals representing said physical parameter from the sensor to the surface equipment via an electrically conductive wire extending through at least part of the auxiliary wellbore.

33. A method for producing fluid in accordance with claim 32, wherein producing fluid from the second fluid zone further comprises lowering the fluid pressure in the first fluid zone relative to the fluid pressure in the second fluid zone by production of fluid from the first fluid zone.

34. A method for producing fluid in accordance with claim 32, wherein at least said second fluid zone is located offshore.

35. A method for producing fluid in accordance with claim 32, wherein said fluid forms a hydrocarbon fluid.

36. A method for producing fluid in accordance with claim 35, wherein said hydrocarbon fluid substantially comprises natural gas.

* * * * *